US006045016A

United States Patent [19]

Okada

[11] Patent Number: 6,045,016

[45] Date of Patent: Apr. 4, 2000

[54] NEEDLE THREADER

[75] Inventor: Tomiji Okada, Osaka, Japan

[73] Assignee: Clover Mfg. Co., Ltd., Osaka, Japan

[21] Appl. No.: 09/338,350

[22] Filed: Jun. 22, 1999

[30] Foreign Application Priority Data

Oct. 13, 1998 [JP] Japan ..... 10-291140
Apr. 16, 1999 [JP] Japan ..... 11-109074

[51] Int. Cl.[7] ..... D05B 87/00

[52] U.S. Cl. ..... 223/99; 112/225

[58] Field of Search ..... 223/99, 1; 112/224, 112/225

[56] References Cited

U.S. PATENT DOCUMENTS 2,338,159 1/1944 Appleton ..... 223/99
2,777,623 1/1957 Balzer ..... 223/99
4,090,649 5/1978 Cichinski ..... 223/99
4,911,341 3/1990 Davis ..... 223/99

FOREIGN PATENT DOCUMENTS 2123448A 2/1984 United Kingdom ..... 112/225

*Primary Examiner*—Bibhu Mohanty
*Attorney, Agent, or Firm*—Merchant & Gould P.C.

[57] ABSTRACT

A needle threader includes a needle holder which has a needle receiving hole and a thread inserting path intersecting the needle receiving hole. A needle position corrector is positioned at one side of the needle holder, and a thread pusher is positioned at the opposite side of the needle holder. The needle position corrector reciprocates into and out of the eye of the needle received in the needle receiving hole, thereby correcting the position of the needle. The thread pusher reciprocates into and out of the thread inserting path for inserting a thread into the needle eye.

17 Claims, 15 Drawing Sheets

NEEDLE THREADER

BACKGROUND OF THE INVENTION

1. Field of the Invention

The present invention relates to a needle threader for inserting a thread into an eye of a sewing needle.

2. Description of the Related Art

In general, it is difficult, particularly for a weak-sighted person, to thread a needle. To facilitate a needle threading operation, a device called "needle threader" is commercially available.

FIGS. 14 through 16 of the accompanying drawings show a typical prior art needle threader. As shown in these figures, the needle threader denoted by a reference sign "B" comprises a synthetic resin body 80, a needle holder 81 extending vertically on the body 80 for receiving a needle 9, a needle pusher 83 located at one side of the needle holder 81, and a thread positioning portion 84 provided between the needle holder 81 and the needle pusher 83 for placing a thread T. The needle holder 81 has a needle receiving hole 81*a* and a thread inserting tunnel 81*b* intersecting the needle receiving hole 81*a*. The needle pusher 83 is reciprocally movable into and out of the thread inserting tunnel 81*b* (as shown by an arrow Na) for inserting the thread T into the eye 90 of the needle 9.

Specifically, as shown in FIG. 14, the needle 9 is positioned in the needle receiving hole 81*a* with its eye 90 directed below, and the thread T is placed between the needle holder 81 and the thread pusher 83. Then, the thread pusher 83 is moved forward to push the thread T, as bent, into the thread inserting tunnel 81*b*, thereby causing the thread T to be inserted into the needle eye 90. When the tip of the thread pusher 83 passes beyond the thread inserting tunnel 81*b*, a part of the thread T also projects out of the thread inserting tunnel 81*b*, as shown in FIG. 15. In this condition, the user nips the projecting part of the thread T for pulling while the thread pusher 83 is allowed to move backward, as shown by solid lines in FIG. 16. Finally, the needle 9 is lifted up out of the needle holder 9 together with the inserted thread T, as shown by broken lines in FIG. 16.

While the prior art needle threader greatly facilitates needle threading in comparison with an entirely manual operation, it still has the following problems.

For ensuring smooth and reliable insertion of the thread T into the needle eye 90, the needle 9 must be accommodated in the needle receiving hole 81*a* accurately so that the needle eye 90 is aligned exactly with the thread inserting tunnel 81*b*. For this purpose, the cross section of the needle receiving hole 81*a* of the needle holder 81 varies gradually from a circular shape to an oval shape for suitably orienting the needle 9 which has a similarly varying cross section. However, since the needle receiving hole 81*a* needs to be slightly larger in cross-sectional size than the needle 9, the needle 9 may rotate slightly about its own axis within the needle receiving hole 81*a*, so that the orientation of the needle eye 90 may deviate or offset slightly from the exact orientation. As a result, the thread pusher 83 may fail to properly insert the thread T into the needle eye 90. Particularly, since the thread pusher 83 must pass the needle eye 90 together with the bent thread T, even a slight offset often obstructs needle threading. Further, the thread pusher 83 may be damaged by such a movement obstruction if the user forces the thread pusher 83 forward.

SUMMARY OF THE INVENTION

It is, therefore, an object of the present invention to provide a needle threader which is capable of appropriately performing a needle threading operation even if the needle eye is improperly oriented.

A needle threader according to the present invention comprises a body and a needle holder carried by the body. The needle holder includes a needle receiving hole and a thread inserting path intersecting the needle receiving hole. The needle threader further comprises a thread pusher supported by the body at one side of the needle holder to reciprocate into and out the thread inserting path for pushing a thread into an eye of a needle which is received in the needle receiving hole, and a needle position corrector supported by the body at an opposite side, from the thread pusher, of the needle holder to reciprocate into and out the thread inserting path.

Preferably, the body may further comprise a projection for forming a thread holding portion between the needle holder and the projection.

According to a preferred embodiment of the present invention, the needle position corrector is movable to a needle catching position where the thread is caught between the needle position corrector and the thread pusher. In this case, a movement regulating mechanism may be additionally provided which causes the thread pusher and the needle position corrector to move integrally with the thread caught therebetween after the needle position corrector reaches the needle catching position. Further, the movement regulating mechanism may have an additional function of allowing the needle position corrector to move separately from the thread pusher when a forward end of the thread pusher advances past the thread inserting path by a predetermined distance.

Specifically, the movement regulating mechanism comprises a pivot supported by the body, a first arm carrying the thread pusher and supported for swinging about the pivot, and a first engaging portion provided on the first arm for regulating separate retreating movement of the needle position corrector. The first arm is pivotable reciprocally between a first position where the thread pusher retreats maximally and a second position where the thread pusher advances maximally.

In addition, the movement regulating mechanism may also comprises a second arm carrying the needle position corrector and supported for swinging about the pivot, and a second engaging portion provided on the second arm for engagement with the first engaging portion to regulate the separate retreating movement of the needle position corrector. The second arm is pivotable reciprocally between a third position where the needle position corrector retreats maximally and a fourth position where the needle position corrector advances.

The movement regulating mechanism may further comprise a guide which has an inclined surface for guiding the second engaging portion into engagement with the first engaging portion. The guide contacts the first engaging portion upon forward swinging of the first arm for causing the first engaging portion to disengage from the second engaging portion.

Preferably, the first arm may be urged toward the first position by a first spring, whereas the second arm may be urged toward the third position by a second spring. The first spring may be formed integrally with the first arm. Similarly, the second spring may be formed integrally with the second arm. Further, each of the first arm and the second arm may have an operating end portion located outside the body.

The thread pusher may a concave tip for effectively catching the thread, whereas the needle position corrector may have a convex tip in complementary relationship to the concave tip of the thread pusher. Alternatively, the needle position corrector may have a concave tip for holding the thread in cooperation with the concave tip of the thread pusher.

The needle threader may further comprise a thread catcher provided on the body. The thread catcher includes an opposed pair of nippers which are normally urged away from each other but elastically movable toward each other for nipping the thread which has passed through the thread inserting path.

The needle threader may further comprise at least one additional needle holder on the body for receiving a differently sized needle.

Other features and advantages of the present invention will become clear from the detailed description to be made hereinafter with reference to the accompanying drawings.

BRIEF DESCRIPTION OF THE DRAWINGS

In the accompanying drawings:

FIG. 6 is an enlarged fragmentary view showing the condition near the needle holder in the thread inserting process step shown in FIG. 5.

FIG. 7 is a vertical sectional view illustrating another step of the thread inserting process using the same needle threader.

FIG. 8 is an enlarged fragmentary view showing the condition near the needle holder in the thread inserting process step shown in FIG. 7.

FIG. 9 is a vertical sectional view illustrating a further step of the thread inserting process using the same needle threader.

DETAILED DESCRIPTION OF THE PREFERRED EMBODIMENTS

The preferred embodiment of the present invention will be specifically described below with reference to the accompanying drawings.

Figure 1:
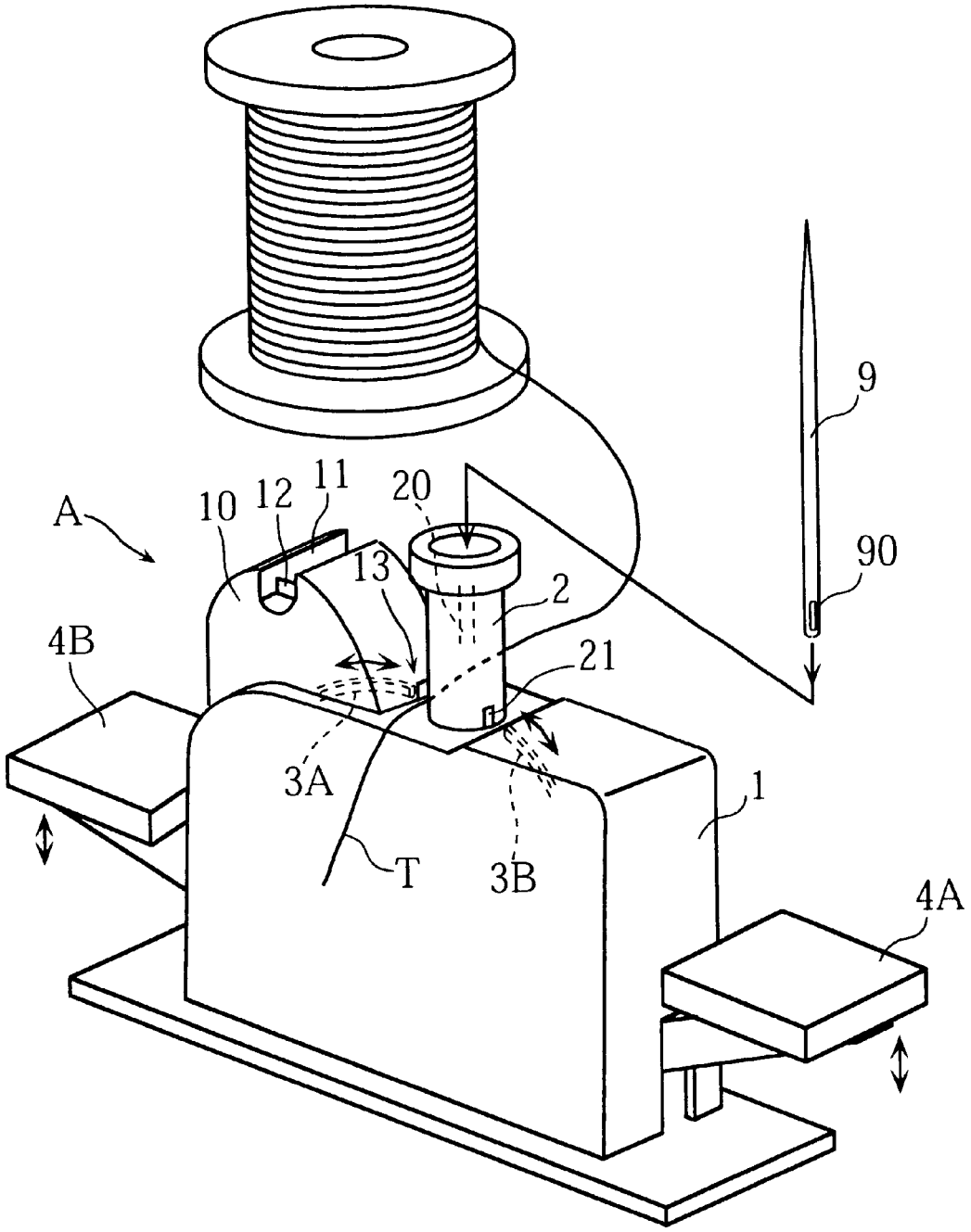
FIG. 1 is a perspective view showing a needle threader embodying the present invention.
Figure 2:
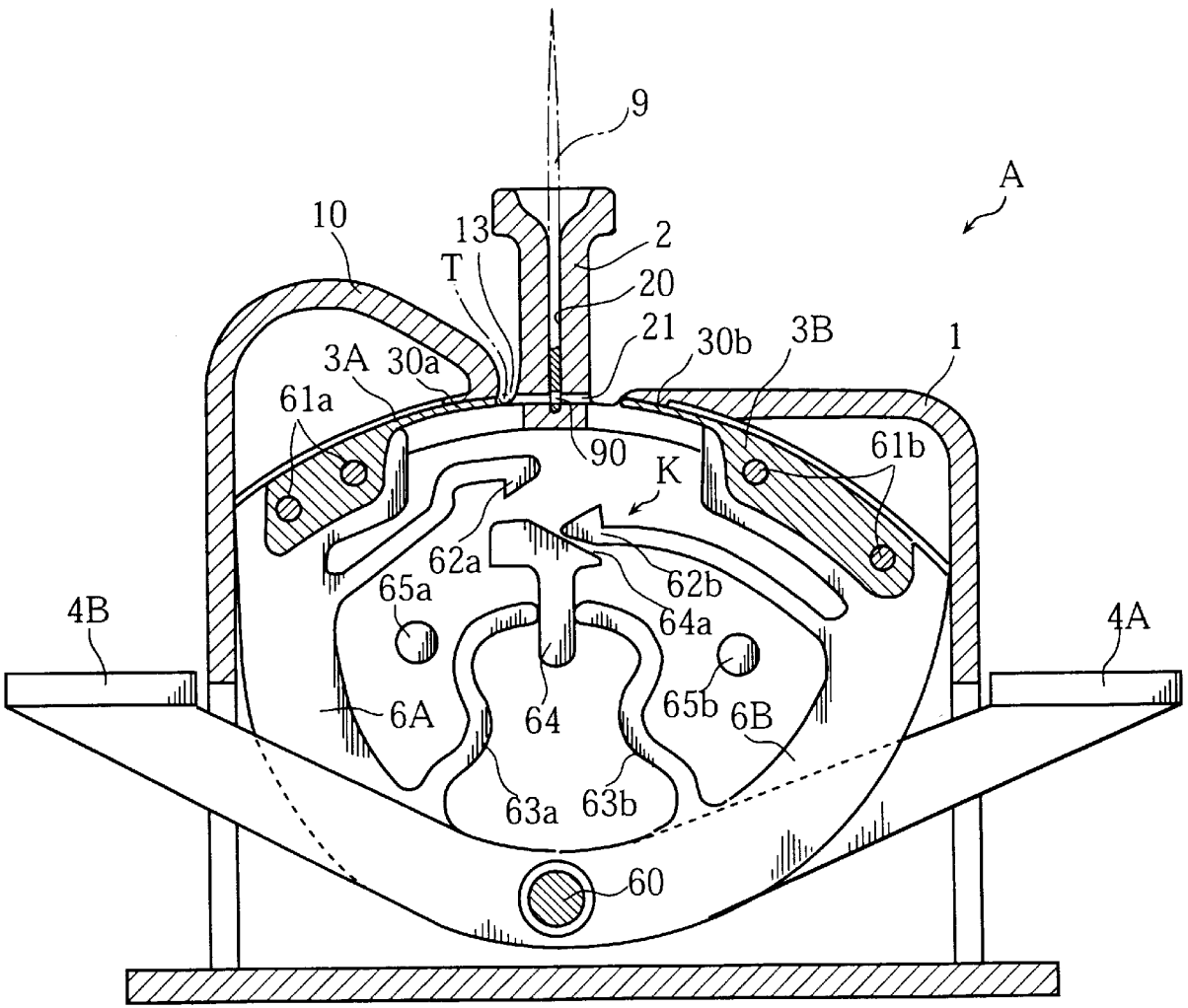
FIG. 2 is a vertical sectional view of the same needle threader.

FIGS. 1 and 2 of the accompanying drawings show a needle threader according to a first embodiment of the present invention. The needle threader of this embodiment comprises a body 1, a needle holder 2, a movement regulating mechanism K, a thread pusher 3A, a needle position corrector 3B, a first operating portion 4A, and a second operating portion 4B.

The body 1 is a hollow casing made of a synthetic resin for example. The body 1 has a domed projection 10 formed with a groove 11 which, in turn, is provided with a cutter 12. The cutter 12, which is used for cutting a thread T, may be omitted. The space formed between the projection 10 and the needle holder 2 is used as a thread positioning portion 13 for positioning a part of the thread T.

As shown in FIG. 2, the needle holder 2 is located on an upper wall of the body 1 and formed into a vertically extending cylinder. The needle holder 2 has a needle receiving hole 20 and a thread inserting path 21.

The needle receiving hole 20 extends vertically and has a bottom surface for preventing a needle 9 from falling. The needle receiving hole 20 is configured to guide the needle 9 such that the eye 90 of the needle 9 is suitably oriented relative to the thread inserting path 21 to a certain extent. Since the cross section of the needle 9 varies longitudinally, the needle receiving hole 20 may be configured to retain the needle 9 by utilizing the cross-sectional size variation. In this case, the needle receiving hole 20 dose not need to have a bottom surface.

The thread inserting path 21 is in the form of a tunnel which extends horizontally in intersecting relationship to the needle receiving hole 20. The thread inserting tunnel 21 is configured such that the respective tips of the thread pusher 3A and the needle position corrector 3B can pass through the thread inserting tunnel 21.

The movement regulating mechanism K includes arms 6A, 6B, engaging portions 62*a*, 62*b*, springs 63*a*, 63*b*, a guide 64, and pins 65*a*, 65*b*. The arms 6A, 6B are pivotally mounted on a common pivot 60 in the body 1. Each of the engaging portions 62*a*, 62*b* is integrally formed with a respective one of the arms 6A, 6B. Each of the springs 63*a*, 63*b*, which may be formed integrally with a respective one of the arms 6A, 6B, is elastically deformable and bears against the guide 64. The pins 65*a*, 65*b* are provided for limiting the pivotal or swinging movement of the respective arms 6A, 6B.

Figure 3:
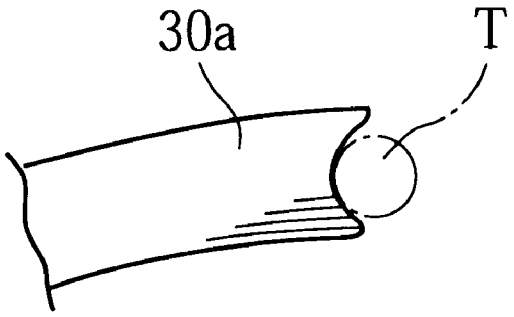
FIG. 3 is an enlarged view showing the tip of the thread pusher of the same needle threader.

The thread pusher 3A may be made of a metal for example. The thread pusher 3A is provided for pushing the thread T positioned at the thread positioning portion 13. The thread pusher 3A has an inserting projection 30*a* for entering into the thread inserting tunnel 21. Preferably, the projection 30*a* has a concave tip for conveniently catching the thread T, as shown in FIG. 3. The thread pusher 3A is mounted on one end of the arm 6A by means of screws 61*a*. The other end of the arm 6A extends out of the body 1, thereby serving as the first operating portion 4A.

Figure 7:
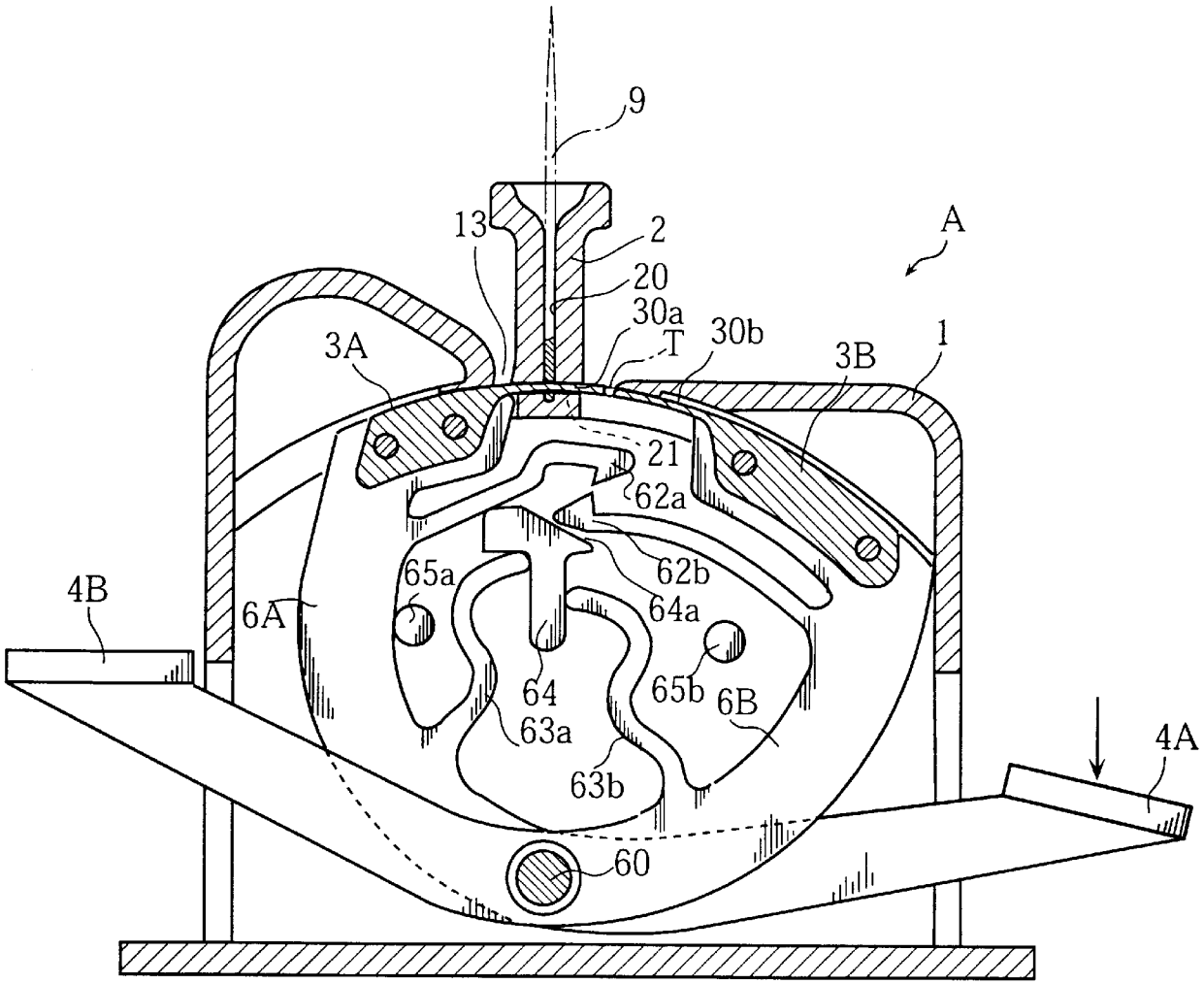

Normally, the thread pusher 3A assumes a maximally retreated position under the projection 10 under the urging force of the spring 63*a*, as shown in FIG. 1. When the first operating portion 4A is pushed downward as shown in FIG. 7, the arm 6A pivots forward against the elastic force of the spring 63*a*, thereby causing the thread pusher 3A to move forward until the arm 6A comes into contact with the pin 65*a*. As a result, the projection 30*a* of the thread pusher 3A advances through the thread inserting tunnel 21 (the needle eye 90 as well). Preferably, the projection 30*a* and the thread inserting tunnel 21 should extend along an arc centered about the pivot 60 for ensuring smooth advancing movement of the thread pusher.

Figure 4:
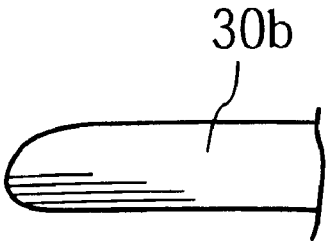
FIG. 4 is an enlarged view showing the tip of the needle position corrector of the same needle threader.

Returning to FIG. 2, the needle position corrector 3B is provided for correcting the orientation of the eye 90 of the needle 9 held in the needle holder 2. The needle position corrector 3B has an inserting projection 30*b* for entry into the thread inserting tunnel 21. Preferably, the projection 30*b* has a convex or tapering tip for fitting in the concave tip of the projection 30*a* of the thread pusher, as shown in FIG. 4. The needle position corrector 3B is mounted on one end of the arm 6B by means of screws 61*b*. The other end of the arm 6B extends out of the body 1, thereby serving as the second operating portion 4B.

Figure 5:
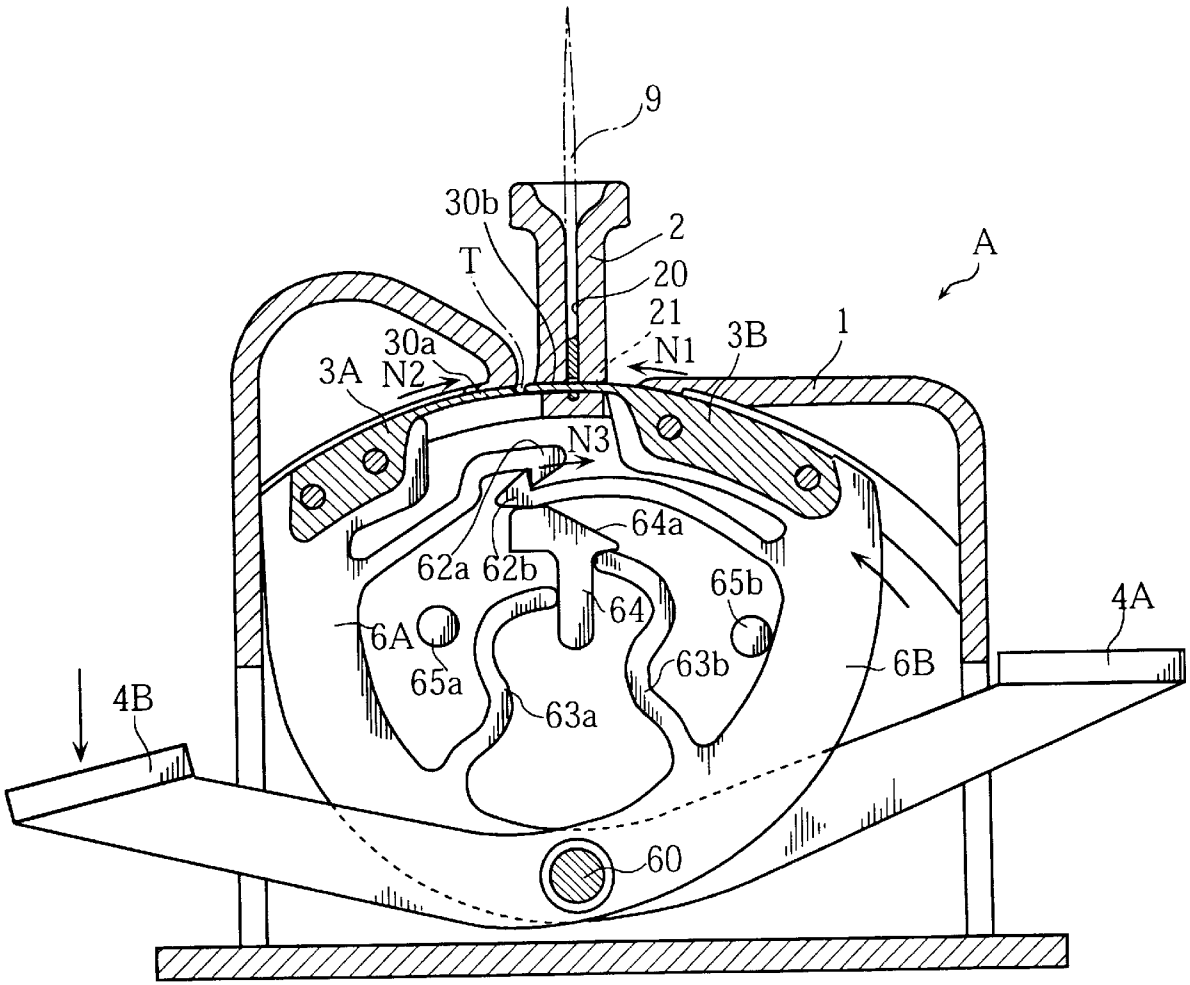
FIGS. 5 through 9 are sectional views showing the successive steps of inserting a thread into a needle eye using the needle threader illustrated in FIG. 1.

Normally, the needle position corrector 3B assumes a maximally retreated position under the upper wall of the body 1. When the second operating portion 4B is pushed downward as shown in FIG. 5, the arm 6B pivots forward against the elastic force of the spring 63*b*, thereby causing the needle position corrector 3B to move forward until the arm 6B comes into stopping contact with the pin 65*b*. As a result, the projection 30*b* of the needle position corrector 3B advances through the thread inserting tunnel 21 (the needle eye 90 as well). Preferably, the projection 30*b* should extend along an arc centered about the pivot 60 for ensuring smooth advancing movement of the needle position corrector.

Since the inserting projection 30*b* of the needle position corrector 3B has a convex or tapered tip, it can be readily inserted into the eye 90 of the needle 9 even if the needle eye 90 is oriented somewhat improperly. Further, the insertion of the projection 30*b* of the needle position corrector 3B through the needle eye 90 causes the needle 9 to rotate slightly about its own axis. As a result, the rotational position of the needle 9 is corrected such that the needle eye 90 is oriented appropriately with respect to the thread pusher 3A for facilitating subsequent insertion of the thread T into the needle eye 90.

Figure 6:
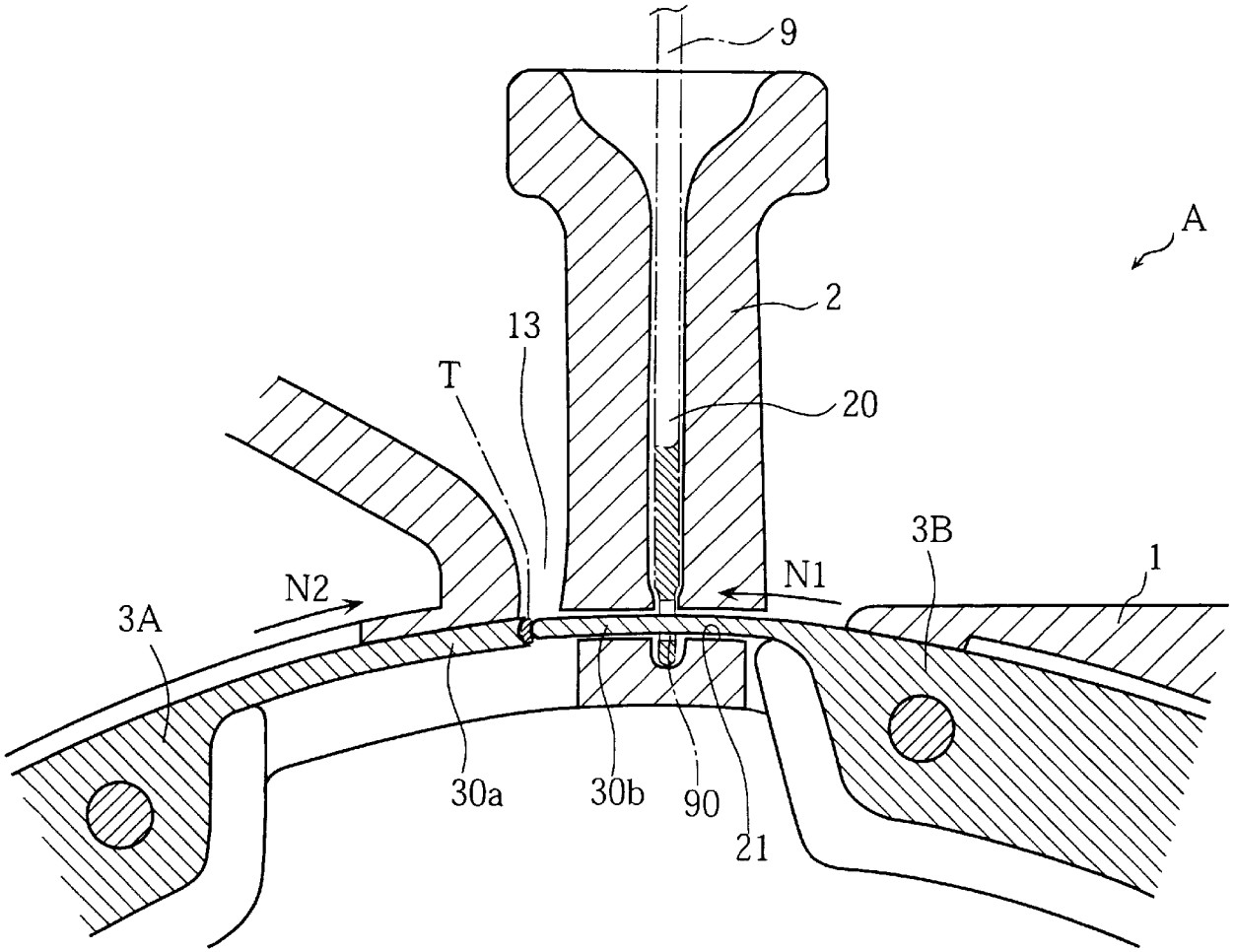

When the second arm 6B pivots forward to a point of contacting the pin 65*b*, the needle position corrector 3B causes the thread T to be caught between the projection 30*a* of the thread pusher 3A and the projection 30*b* of the needle position corrector 3B, as shown in FIGS. 5 and 6.

During the above-described pivotal movement of the second arm 6B, the taper face 64*a* of the guide 64 guides the engaging portion 62*b* into engagement with the engaging portion 62*a* of the first arm 6A, so that the second arm 6B is prevented from pivotally returning to its original position by itself even under the restoring force of the spring 63*b*. As a result, the needle position corrector 3B moves backward integrally with the thread pusher 3A to a point where the two springs 63*a*, 63*b* come in balance.

In this state, a downward push on the first operating portion 4A of the first arm 6A prompts the thread pusher 3A to move toward the thread inserting tunnel 21, as indicated by an arrow N2 in FIGS. 5 and 6. Similarly, the engaging portion 62*a* of the first arm 6A also moves forwardly, as indicated by an arrow N3 in FIG. 5, whereby the engaging portion 62*b* of the second arm 6B is allowed to move in the same direction (rearwardly with respect to the second arm 6B) by the same amount. As a result, the needle position corrector 3B moves backward with the thread T caught between the thread pusher 3A and the need position corrector 3B.

Figure 8:
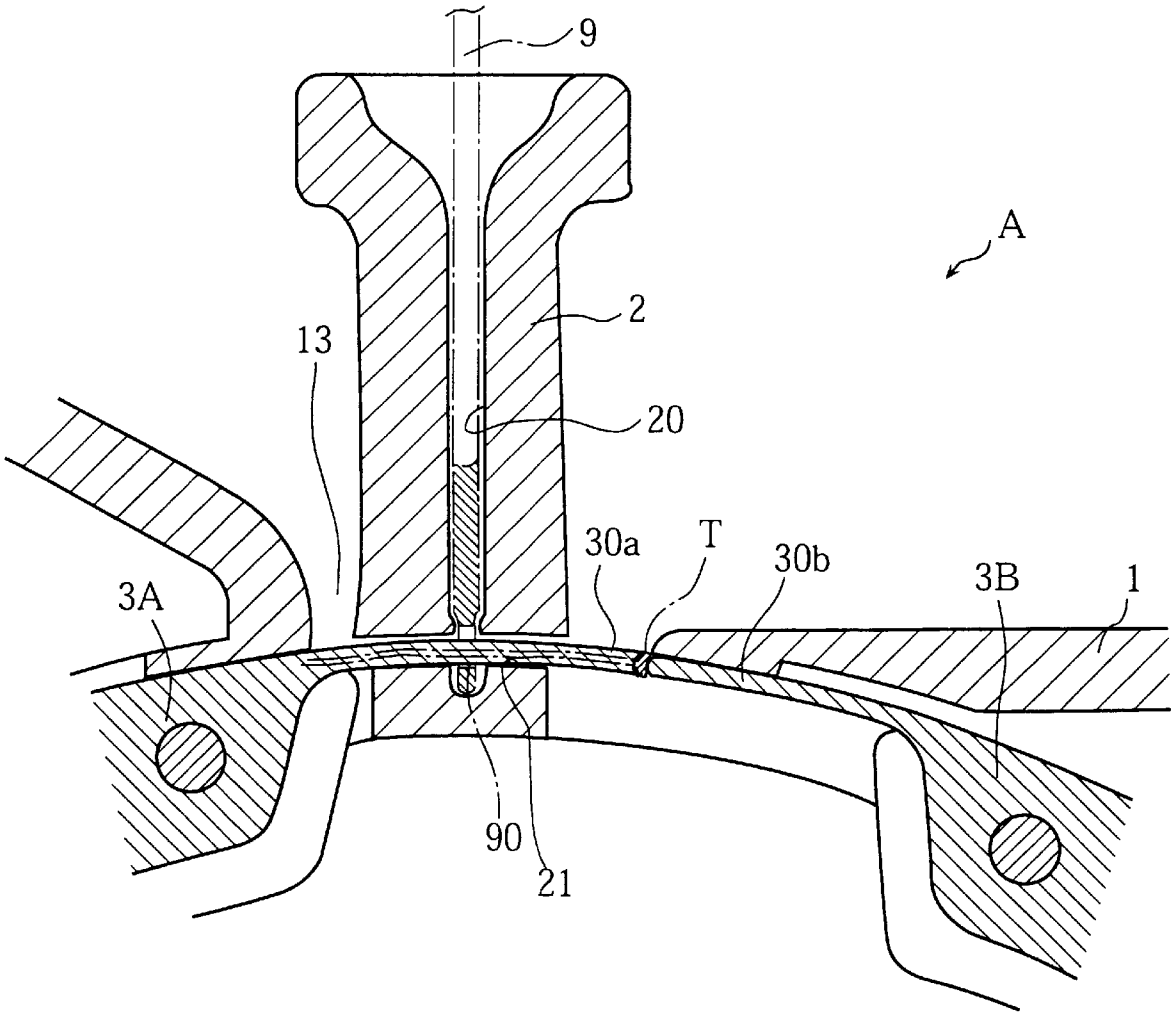

While the thread pusher 3A advances, the projection 30*a* of the thread pusher 3A enters the thread inserting path 21, passes through the needle eye 90, and penetrates out of the thread inserting tunnel 21, as shown in FIGS. 7 and 8. As a result, the thread T is inserted into the needle eye 90 and taken out of the thread inserting tunnel 21. In this regard, since the orientation of the needle eye 90 has been corrected due to the previous passage of the needle position corrector 3B, the thread T can be reliably inserted into the needle eye 90. Further, since the thread pusher 3A can enter the needle eye 90 smoothly due to its proper orientation, the inserting projection 30*a* of the thread pusher 3A does not come into improper contact with the needle 9 and therefore is unlikely to be damaged. Moreover, since the thread T is held securely between the thread pusher 3A and the needle position corrector 3B at the time of passing through the thread inserting tunnel 21 and the needle eye 90, the thread T is unlikely to be withdrawn under friction even though the thread T is bent at the tip of the thread pusher 3A.

Figure 9:
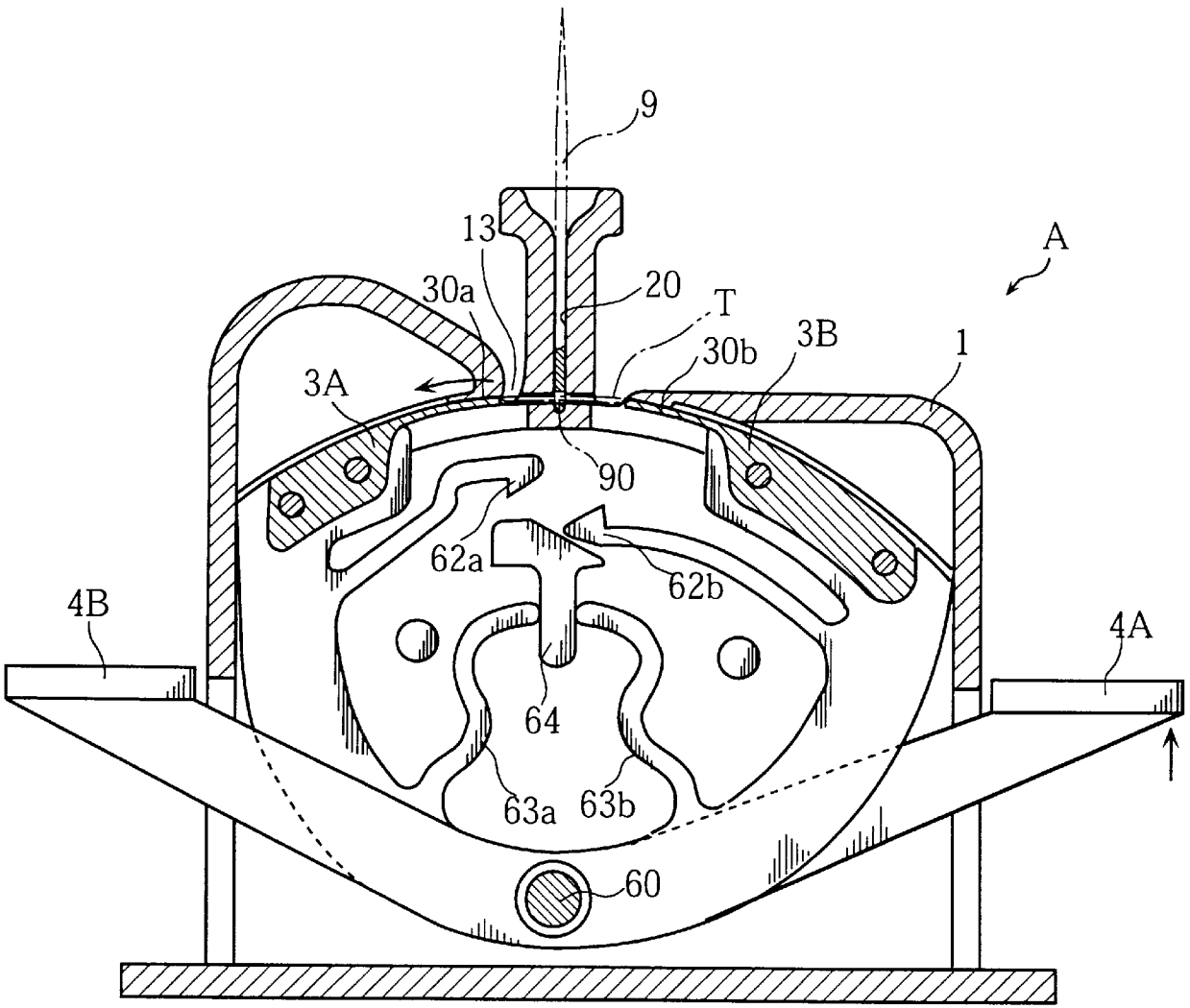

A further push on the first operating portion 4A causes the engaging portion 62*b* of the second arm 6B to be disengaged from the engaging portion 62*a* of the first arm 6A, as shown in FIG. 7. Such disengagement occurs because the engaging portion 62*a* of the first arm 6A rides on the guide 64 in its advancing movement and is thereby lifted up. In this condition, if the first operating portion 4A is liberated from a pushing force, the first arm 6A together with the thread pusher 3A returns to the original normal position under the elastic force of the spring 63*a* while the thread T remains inserted in the needle eye 90, as shown in FIG. 9. It should be appreciated here that the forward movement of the thread pusher 3A is limited by the pin 65*a* which comes into stopping engagement with the forwardly pivoted first arm 6A.

To finalize the needle threading operation, the thread T is extended by manually pulling an exposed part of the thread T. Then, the needle 9 is picked up from the needle receiving hole 20 to take the inserted thread T out of the needle receiving hole 20.

FIGS. 10 through 13 show other embodiments of the present invention. In these figures, the same signs with or without primes (' or ") are used to represent the elements which are identical or similar to those of the first embodiment.

Figure 10:
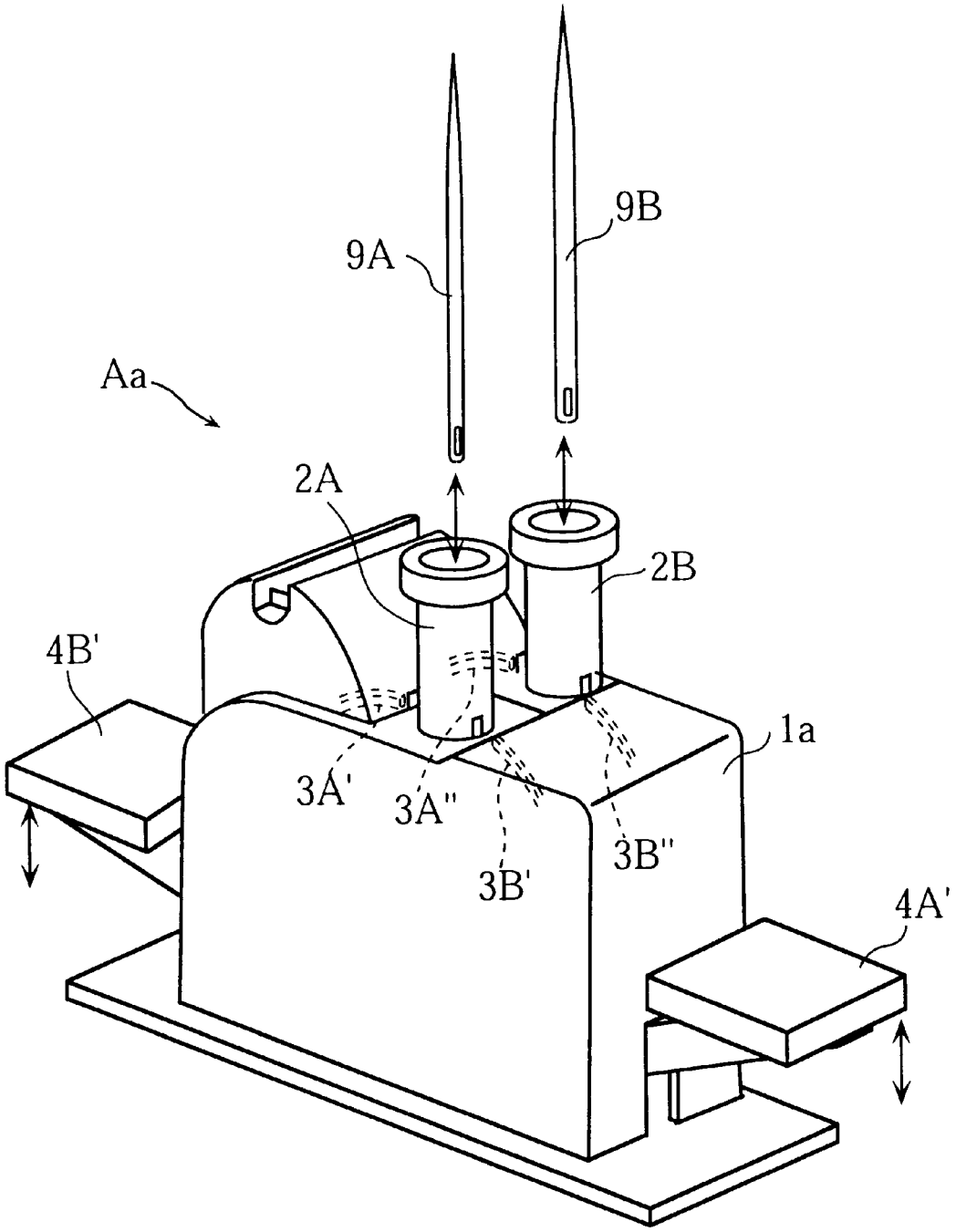
FIG. 10 shows a perspective view showing another needle threader embodying the present invention.

Referring to FIG. 10 showing a second embodiment of the present invention, a needle threader Aa includes a body 1*a*, two needle holders 2A, 2B on the body 1*a*, two thread pushers 3A', 3A", two needle position correctors 3B', 3B", and operating portions 4A', 4B'. One needle holder 2A is used for receiving a thinner needle 9A, whereas the other needle holder 2B is used for receiver a thicker needle 9B. The two thread pushers 3A', 3A" are operated simultaneously and commonly for threading by the operating portion 4A'. Similarly, the two needle position correctors 3B', 3B" are operated simultaneously and commonly for correction of the needle position (i.e., the needle eye orientation) by the operating portion 4B'. The second embodiment is advantageous in that needle threading may be performed with respect to one or both of the two diametrically different needles 9A, 9B.

Figure 11:
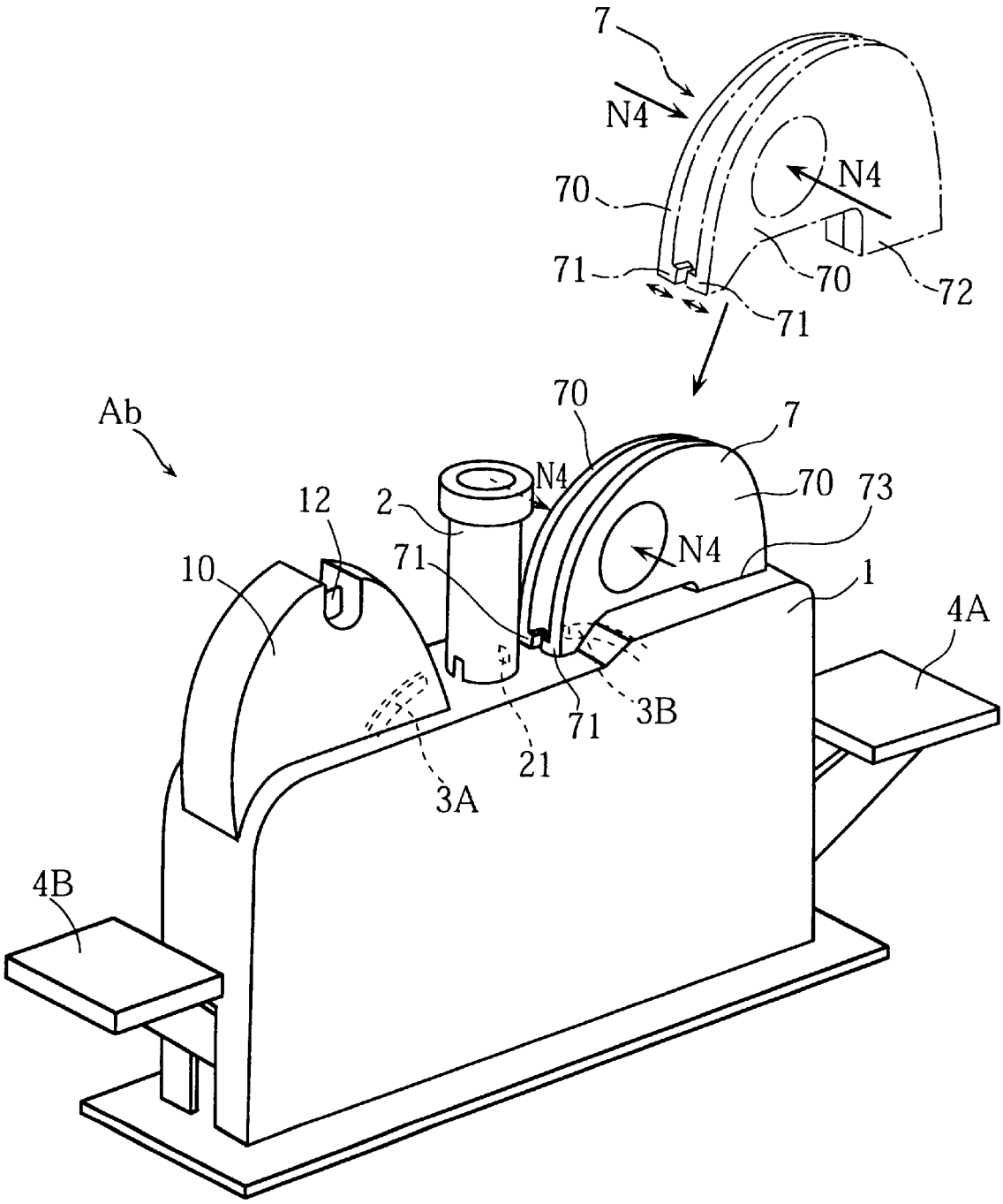
FIG. 11 is a perspective view showing a further needle threader embodying the present invention.
Figure 12:
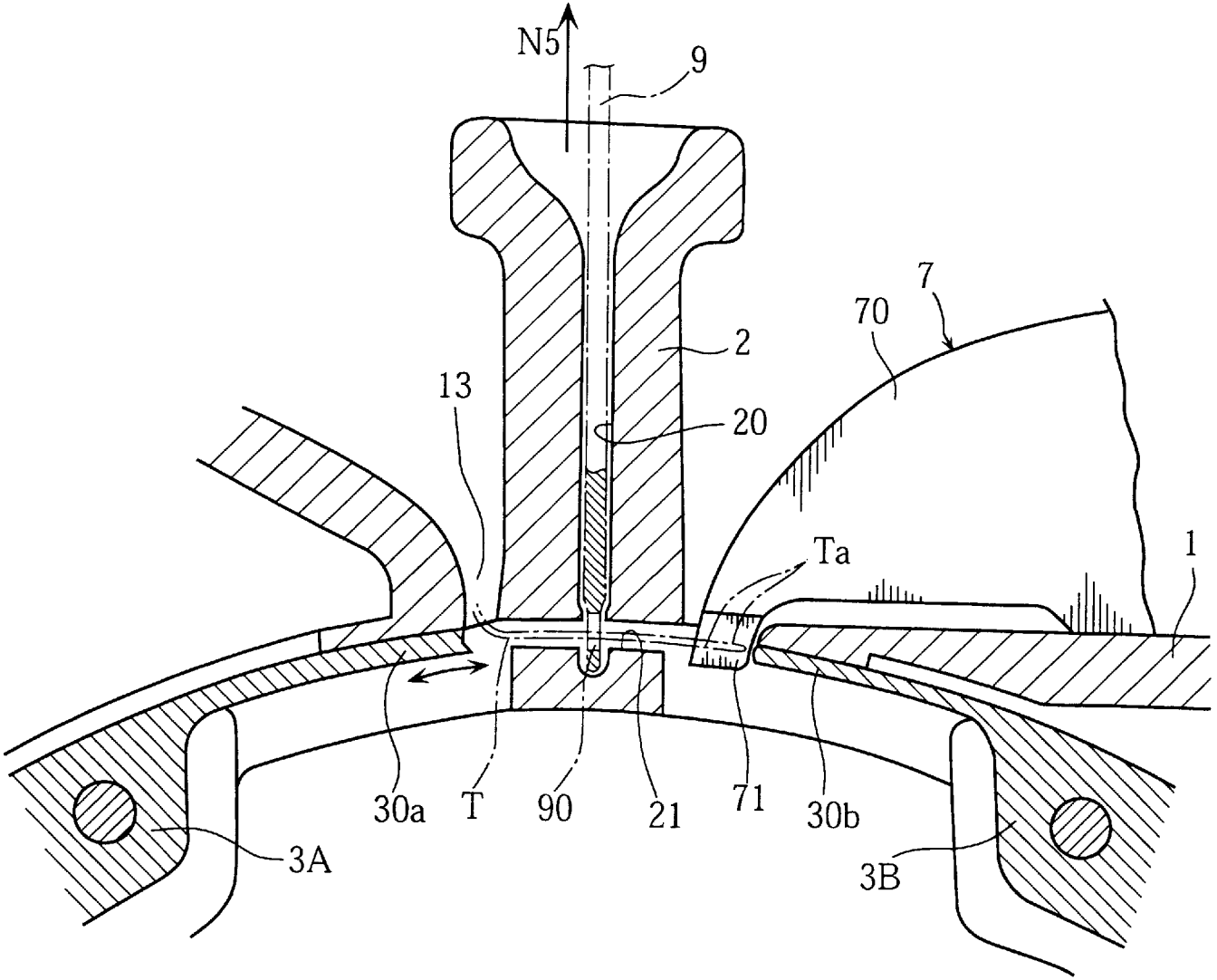
FIG. 12 is an enlarged fragmentary sectional view showing a principal portion of the needle threader illustrated in FIG. 11.

Referring to FIGS. 11 and 12 showing a third embodiment of the present invention, a needle threader Ab comprises a thread catcher 7 in addition to those elements which are provided for the first embodiment. The thread catcher 7 includes an opposed pair of nippers 70 made of elastic synthetic resin. Each of the nippers 70 has a catching tip 71 shaped suitably for engaging a thread Ta (FIG. 12). The paired catching tips 71 are normally open but may be forced toward each other for holding the thread Ta, as indicated by arrows N4 in FIG. 11. The thread catcher 7 also has a downwardly directed mounting projection 72 which fits in a mounting hole 73 formed on the upper wall of the body 1 for connection thereto. In the thus mounted state, the paired catching tips 71 of the thread catcher 7 are located adjacent to the outlet end of the thread inserting tunnel 21. The thread catcher 7 may be used like a pair of forceps. As shown in FIG. 12, the thread catcher 7 can reliably catch an exposed portion of the thread Ta projecting out of the thread inserting tunnel 21 even if the projecting length of the thread Ta is short. Such catching prevents the thread T from being unexpectedly withdrawn from the needle eye 90 when the needle 9 is picked up out of the needle receiving hole 20 after the thread inserting operation, as indicated by an arrow N5 in FIG. 12.

Figure 13A:
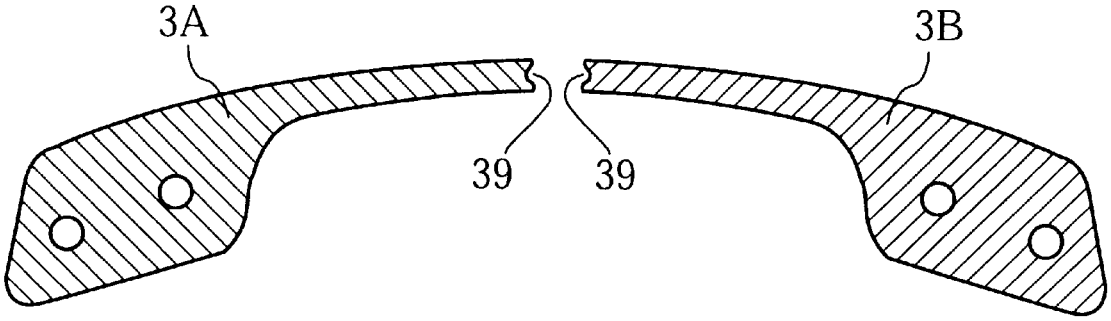
FIG. 13*a* is an enlarged sectional view showing the needle pusher and the needle position corrector employed in the embodiment shown in FIG. 11.
Figure 13B:
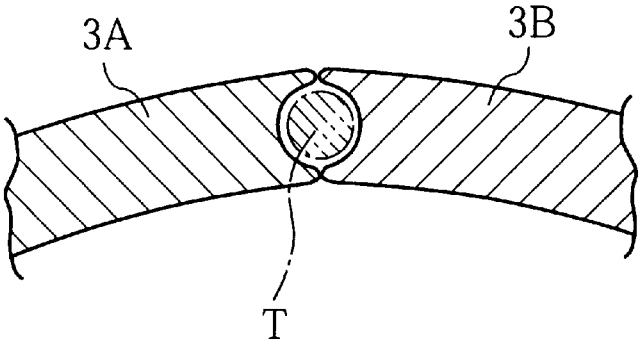
FIG. 13*b* is an additionally enlarged sectional view illustrating the needle pusher and the needle position corrector with a thread held therebetween.
Figure 14:
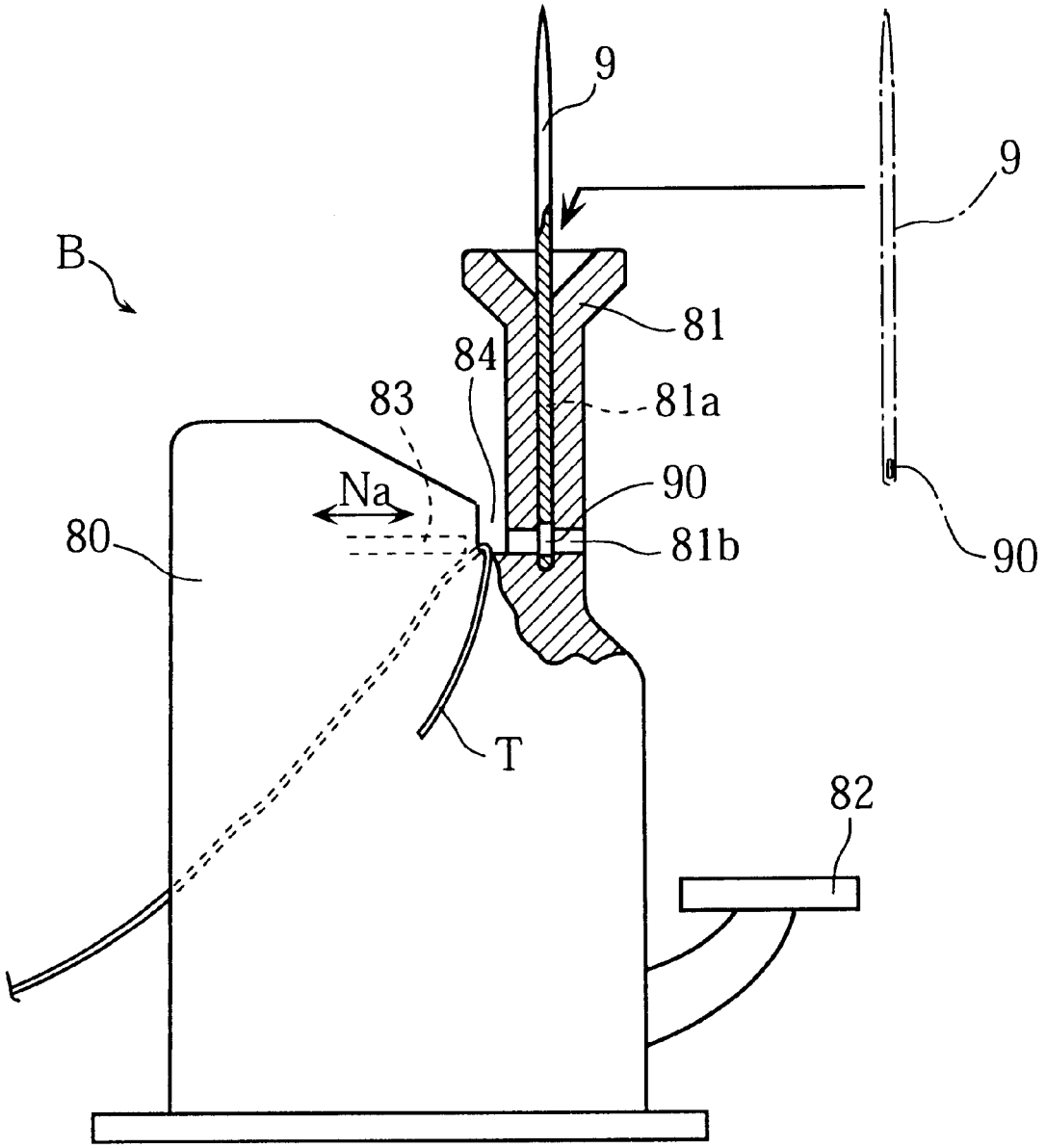
FIG.14 PRIOR ART
FIGS. 14 through 16 are views, partly in section, illustrating the successive steps of inserting a thread into a needle eye with the use of a prior art needle threader.
Figure 15:
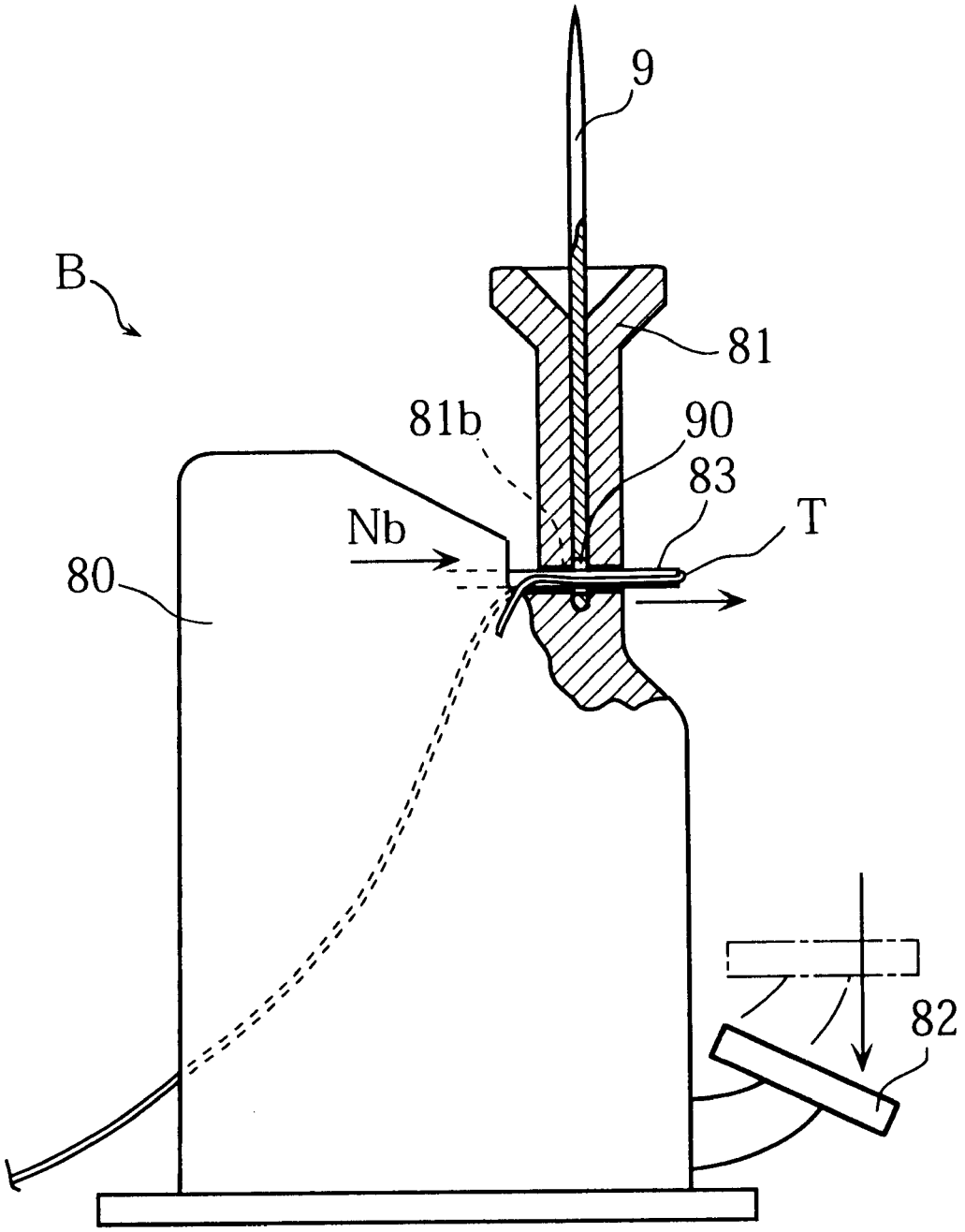
FIG.15 PRIOR ART
Figure 16:
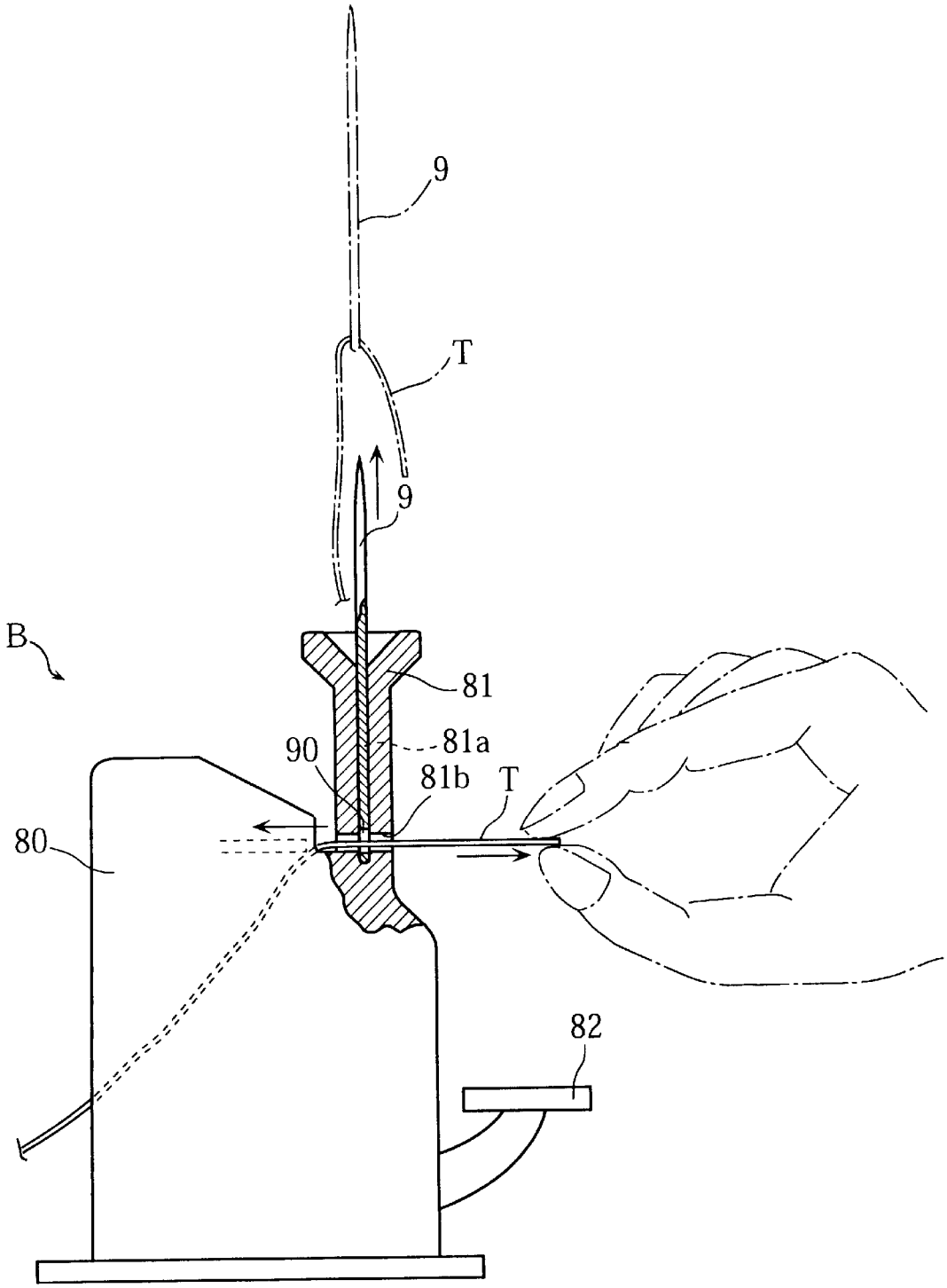
FIG.16 PRIOR ART

Referring to FIG. 13*a*, each of the thread pusher 3A and the needle position corrector 3B may have a concave tip 39. Due to such a design, the thread pusher 3A and the needle position corrector 3B are identical in configuration, thereby simplifying the manufacturing process to realize a cost reduction. In addition, when holding a thread T between the thread pusher 3A and the needle position corrector 3B, the paired concave tips 39 can surround the thread T, thereby preventing the thread T from dropping off and from being squeezed.

The present invention being thus described, it is obvious that the same may be varied in many ways. While, according to the illustrated embodiments, the thread is caught between the thread pusher and the needle position corrector when the thread pusher pushes the thread, the thread pusher may move independently of the needle position corrector at the time of pushing the thread, whereas the needle position corrector may serve the sole purpose of correcting the orientation of the needle eye. Such a variation should not be regarded as a departure from the spirit and scope of the present invention, and all such modifications as would be obvious to those skilled in the art are intended to be included in the scope of the appended claims.

I claim:

1. A needle threader comprising:

a body;

a needle holder carried by the body, the needle holder including a needle receiving hole and a thread inserting path intersecting the needle receiving hole;

a thread pusher supported by the body at one side of the needle holder to reciprocate into and out the thread inserting path for pushing a thread into an eye of a needle which is received in the needle receiving hole; and a needle position corrector supported by the body at an opposite side, from the thread pusher, of the needle holder to reciprocate into and out the thread inserting path.

2. The needle threader according to claim 1, wherein the body further comprises a projection for forming a thread holding portion between the needle holder and the projection.

3. The needle threader according to claim 1, wherein the needle position corrector is movable to a needle catching position where the thread is caught between the needle position corrector and the thread pusher.

4. The needle threader according to claim 3, further comprising a movement regulating mechanism which causes the thread pusher and the needle position corrector to move integrally with the thread caught therebetween after the needle position corrector reaches the needle catching position.

5. The needle threader according to claim 4, wherein the movement regulating mechanism allows the needle position corrector to move separately from the thread pusher when a forward end of the thread pusher advances past the thread inserting path by a predetermined distance.

6. The needle threader according to claim 4, wherein the movement regulating mechanism comprises:

a pivot supported by the body;

a first arm carrying the thread pusher and supported for swinging about the pivot; and a first engaging portion provided on the first arm for regulating separate retreating movement of the needle position corrector;

wherein the first arm is pivotable reciprocally between a first position where the thread pusher retreats maximally and a second position where the thread pusher advances maximally.

7. The needle threader according to claim 6, wherein the movement regulating mechanism further comprises:

a second arm carrying the needle position corrector and supported for swinging about the pivot; and a second engaging portion provided on the second arm for engagement with the first engaging portion to regulate the separate retreating movement of the needle position corrector;

wherein the second arm is pivotable reciprocally between a third position where the needle position corrector retreats maximally and a fourth position where the needle position corrector advances maximally.

8. The needle threader according to claim 7, wherein the movement regulating mechanism further comprises a guide which has an inclined surface for guiding the second engaging portion into engagement with the first engaging portion.

9. The needle threader according to claim 8, wherein the guide contacts the first engaging portion upon forward swinging of the first arm for causing the first engaging portion to disengage from the second engaging portion.

10. The needle threader according to claim 7, further comprising a first spring for urging the first arm toward the first position, and a second spring for urging the second arm toward the third position.

11. The needle threader according to claim 10, wherein the first spring is formed integrally with the first arm and the second spring is formed integrally with the second arm.

12. The needle threader according to claim 7, wherein each of the first arm and the second arm has an operating end portion located outside the body.

13. The needle threader according to claim 1, wherein the thread pusher has a concave tip.

14. The needle threader according to claim 1, wherein the needle position corrector has a convex tip.

15. The needle threader according to claim 1, wherein the needle position corrector has a concave tip.

16. The needle threader according to claim 1, further comprising a thread catcher provided on the body, wherein the thread catcher comprises an opposed pair of nippers which are normally urged away from each other but elastically movable toward each other for nipping the thread which has passed through the thread inserting path.

17. The needle threader according to claim 1, further comprising at least one additional needle holder on the body for receiving a differently sized needle.

* * * * *